US010339734B2

(12) United States Patent
Bauer et al.

(10) Patent No.: US 10,339,734 B2
(45) **Date of Patent: *Jul. 2, 2019**

(54) INTERNET-CONNECTED GARAGE DOOR CONTROL SYSTEM

(71) Applicant: Gentex Corporation, Zeeland, MI (US)

(72) Inventors: Frederick T. Bauer, Holland, MI (US); Robert R. Turnbull, Holland, MI (US); Uma Ivaturi, Holland, MI (US)

(73) Assignee: GENTEX CORPORATION, Zeeland, MI (US)

( * ) Notice: Subject to any disclaimer, the term of this patent is extended or adjusted under 35 U.S.C. 154(b) by 76 days.

This patent is subject to a terminal disclaimer.

(21) Appl. No.: 15/658,575

(22) Filed: Jul. 25, 2017

(65) Prior Publication Data

US 2017/0323498 A1 Nov. 9, 2017

Related U.S. Application Data

(63) Continuation of application No. 14/541,360, filed on Nov. 14, 2014, now Pat. No. 9,715,772.
(Continued)

(51) Int. Cl.
*G07C 9/00* (2006.01)

(52) U.S. Cl.
CPC ..... *G07C 9/00007* (2013.01); *G07C 9/00182* (2013.01); *G07C 9/00309* (2013.01);
(Continued)

(58) Field of Classification Search
None
See application file for complete search history.

(56) References Cited

U.S. PATENT DOCUMENTS 5,442,340 A 8/1995 Dykema
5,479,155 A 12/1995 Zeinstra et al.
(Continued)

FOREIGN PATENT DOCUMENTS

DE 4302015 A1 8/1993
EP 1014326 A1 6/2000
(Continued)

OTHER PUBLICATIONS

Craftsman, AssureLink Brochure, Jul. 10, 2013, http://c.shld.net/assets/docs/spin_prod_858057212.pdf, pp. 1-4.*

*Primary Examiner* — Daniell L Negron
(74) *Attorney, Agent, or Firm* — Price Heneveld LLP; Bradley D. Johnson

(57) ABSTRACT

An internet-connected garage door control system is disclosed that includes a garage door opener for opening and closing a garage door in response to signals received through the internet, and an in-vehicle remote garage door opener integrated into a vehicle for transmitting the signals through the internet to the garage door opener. The in-vehicle remote garage door opener includes an interface configured to communicate with an internet-connected device, a trainable RF transceiver for transmitting an RF signal to the garage door opener, a user-actuated input, an interface configured to communicate with an internet-connected device, and a controller, wherein, upon actuation of the user-actuated input, the controller is configured to at least one of (a) request a signal to be transmitted by the internet-connected device through the internet to the garage door opener, and (b) cause the trainable RF transceiver to transmit the RF signal to the garage door opener.

19 Claims, 3 Drawing Sheets

Related U.S. Application Data

(60) Provisional application No. 61/904,615, filed on Nov. 15, 2013.

(52) U.S. Cl.
CPC ..... *G07C 2009/00206* (2013.01); *G07C 2009/00253* (2013.01); *G07C 2009/00928* (2013.01); *G07C 2209/62* (2013.01)

(56) References Cited

U.S. PATENT DOCUMENTS 5,583,485 A 12/1996 Van Lente et al.
5,614,891 A 3/1997 Zeinstra et al.
5,619,190 A 4/1997 Duckworth et al.
5,627,529 A 5/1997 Duckworth et al.
5,646,701 A 7/1997 Duckworth et al.
5,661,804 A 8/1997 Dykema et al.
5,686,903 A 11/1997 Duckworth et al.
5,699,054 A 12/1997 Duckworth
5,699,055 A * 12/1997 Dykema ..... G08C 17/02 340/13.24
5,708,415 A 1/1998 Van Lente et al.
5,761,206 A 6/1998 Kackman
5,793,300 A 8/1998 Suman et al.
5,854,593 A 12/1998 Dykema et al.
5,896,575 A 4/1999 Higginbotham et al.
5,903,226 A 5/1999 Suman et al.
5,905,433 A 5/1999 Wortham
5,940,000 A 8/1999 Dykema
6,028,537 A 2/2000 Suman et al.
6,091,343 A 7/2000 Dykema et al.
6,426,820 B1 7/2002 Verzulli
6,433,699 B1 8/2002 Slomowitz et al.
6,731,198 B1 5/2004 Stobbe et al.
6,965,757 B2 11/2005 Eray
6,970,082 B2 11/2005 Reese et al.
6,978,126 B1 12/2005 Blaker et al.
6,980,117 B1 12/2005 Kirkland et al.
7,197,278 B2 3/2007 Harwood et al.
7,257,426 B1 8/2007 Witkowski et al.
7,346,374 B2 3/2008 Witkowski et al.
7,349,722 B2 3/2008 Witkowski et al.
7,469,129 B2 12/2008 Blaker et al.
7,532,965 B2 5/2009 Robillard et al.
7,778,604 B2 8/2010 Bauman et al.
7,786,843 B2 8/2010 Witkowski
7,864,070 B2 1/2011 Witkowski et al.
7,889,050 B2 2/2011 Witkowski
7,911,358 B2 3/2011 Bos et al.
7,970,446 B2 6/2011 Witkowski et al.
8,000,667 B2 8/2011 Witkowski et al.
8,049,595 B2 11/2011 Olson et al.
8,165,527 B2 4/2012 Sims et al.
8,174,357 B2 5/2012 Geerlings et al.
8,253,528 B2 8/2012 Blaker
8,264,333 B2 9/2012 Blaker et al.
8,384,580 B2 2/2013 Witkowski et al.
8,427,288 B2 * 4/2013 Schofield ..... B60C 23/00 340/425.5
8,494,449 B2 7/2013 Witkowski et al.
8,531,266 B2 9/2013 Shearer et al.
8,643,481 B2 2/2014 Campbell et al.
8,760,267 B2 6/2014 Bos et al.
2002/0044065 A1 4/2002 Quist et al.
2002/0180600 A1 12/2002 Kirkland et al.
2002/0190872 A1 12/2002 Suman et al.
2002/0197955 A1 12/2002 Witkowski et al.
2003/0197594 A1 10/2003 Olson et al.
2004/0202327 A1 10/2004 Little et al.
2004/0266419 A1 12/2004 Arling et al.
2004/0267103 A1 12/2004 Li et al.
2004/0267705 A1 12/2004 Lemus et al.
2005/0134477 A1 6/2005 Ghabra et al.
2006/0158344 A1 7/2006 Bambini et al.
2006/0187034 A1 8/2006 Styers et al.
2007/0167138 A1 7/2007 Bauman et al.
2008/0062000 A1 3/2008 Styers et al.
2008/0079570 A1 4/2008 Fineman et al.
2009/0021348 A1 1/2009 Farris et al.
2009/0315751 A1 12/2009 Bennie et al.
2010/0171588 A1 * 7/2010 Chutorash ..... G07C 9/00182 340/5.71
2011/0025456 A1 2/2011 Bos et al.
2011/0112969 A1 5/2011 Zaid et al.
2011/0248866 A1 10/2011 Chutorash et al.
2013/0147616 A1 6/2013 Lambert et al.
2013/0151977 A1 6/2013 Arteaga-King et al.
2014/0009263 A1 1/2014 Shearer et al.
2014/0111315 A1 4/2014 Geerlings et al.
2014/0118119 A1 5/2014 Geerlings et al.
2017/0320464 A1 11/2017 Schultz

FOREIGN PATENT DOCUMENTS

JP 10176448 A 6/1998
JP 10191464 A 7/1998
JP 2001012176 A 1/2001
KR 20040058656 A 7/2004
RU 2214065 10/2003
RU 2402074 10/2010
WO 0075905 A1 12/2000
WO 2004036526 A2 4/2004
WO 2008079811 7/2008

* cited by examiner

INTERNET-CONNECTED GARAGE DOOR CONTROL SYSTEM

CROSS-REFERENCE TO RELATED APPLICATION

This application is a continuation of U.S. patent application Ser. No. 14/541,360, filed on Nov. 14, 2014, entitled "INTERNET-CONNECTED GARAGE DOOR CONTROL SYSTEM," now U.S. Pat. No. 9,715,772, which claims priority to and the benefit under 35 U.S.C. § 119(e) of U.S. Provisional Patent Application No. 61/904,615, filed on Nov. 15, 2013, entitled "INTERNET-CONNECTED GARAGE DOOR CONTROL SYSTEM," the entire disclosure of which is hereby incorporated herein by reference.

FIELD OF THE INVENTION

The present invention generally relates to garage door control systems, and more particularly, internet-connected garage door control systems and in-vehicle remote garage door openers.

SUMMARY OF THE INVENTION

According to one aspect of the present invention, an internet-connected garage door control system is provided comprising a garage door opener for opening and closing a garage door in response to signals received through the internet and in response to RF signals, and an in-vehicle remote garage door opener integrated into a vehicle, the in-vehicle remote garage door opener comprising: a trainable RF transceiver for receiving an RF signal during a training mode and transmitting an RF signal to the garage door opener in an operating mode; a user-actuated input; an interface configured to communicate with an internet-connected device; and a controller coupled to the user-actuated input, the trainable RF transceiver, and the interface, wherein, upon actuation of the user-actuated input, the controller is configured to at least one of (a) request a signal to be transmitted by the internet-connected device through the internet to the garage door opener that responds to the signals by opening/closing a garage door, and (b) cause the trainable RF transceiver to transmit the RF signal to the garage door opener that responds to the signals by opening/closing the garage door.

According to another embodiment of the present invention, an in-vehicle remote garage door opener is provided that is integrated into a vehicle for transmitting signals through the internet to a garage door opener, the remote garage door opener comprising: a trainable RF transceiver for receiving an RF signal during a training mode and transmitting an RF signal to the garage door opener in an operating mode; a user-actuated input; an interface configured to communicate with an internet-connected device; and a controller coupled to the user-actuated input, the trainable RF transceiver, and the interface, wherein, upon actuation of the user-actuated input, the controller is configured to at least one of (a) request a signal to be transmitted by the internet-connected device through the internet to the garage door opener that responds to the signal by opening/closing a garage door, and (b) cause the trainable RF transceiver to transmit the RF signal to the garage door opener that responds to the signals by opening/closing the garage door.

These and other features, advantages, and objects of the present invention will be further understood and appreciated by those skilled in the art by reference to the following specification, claims, and appended drawings.

BRIEF DESCRIPTION OF THE DRAWINGS

The present invention will become more fully understood from the detailed description and the accompanying drawings, wherein.

DETAILED DESCRIPTION OF THE EMBODIMENTS

Figure 1:
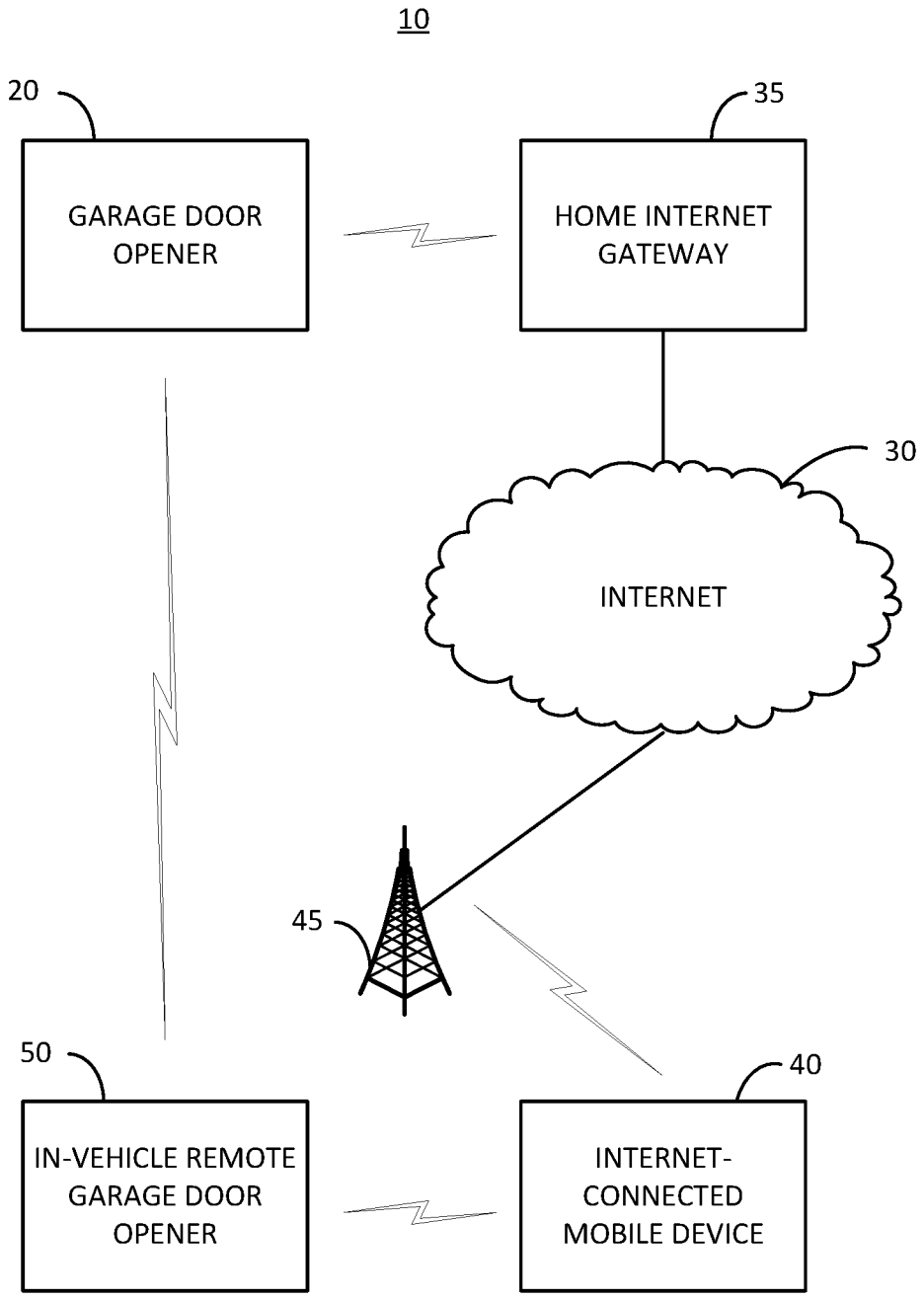
FIG. 1 is a block diagram showing an internet-connected garage door control system according to embodiments of the present invention.

Reference will now be made in detail to the present preferred embodiments of the invention, examples of which are illustrated in the accompanying drawings. Wherever possible, the same reference numerals will be used throughout the drawings to refer to the same or like parts. In the drawings, the depicted structural elements are not to scale and certain components are enlarged relative to the other components for purposes of emphasis and understanding.

The terms "including," "comprises," "comprising," or any other variation thereof are intended to cover a non-exclusive inclusion, such that a process, method, article, or apparatus that comprises a list of elements does not include only those elements, but may include other elements not expressly listed or inherent to such process, method, article, or apparatus. An element preceded by "comprises . . . a" does not, without more constraints, preclude the existence of additional identical elements in the process, method, article, or apparatus that comprises the element.

FIG. 1 shows an example of an internet-connected garage door control system 10 according to embodiments of the present invention. Control system 10 includes a garage door opener 20 that may be, for example, a Chamberlain MyQ® brand smartphone garage opener. Such an opener is accessed through the internet 30 through a home internet gateway 35 that is connected via conventional means to the internet 30. Garage door opener 20 may connect to home internet gateway 35 via Bluetooth®, Bluetooth® Low Energy, WiFi, wired Ethernet or a special purpose wireless (RF) link.

The garage door status can be monitored and the door opened or closed remotely via the internet using an internet-connected mobile device 40, such as a smartphone, for example. The internet-connected mobile device 40 connects to the internet 30 through a cellular telephone tower 45 or through other known means such as WiFi.

The internet-connected garage door control system 10 differs from prior systems in that it further incorporates an in-vehicle remote garage door opener 50. In-vehicle remote garage door openers are generally known, such as the HOMELINK® trainable remote garage door opener available from Gentex Corporation of Zeeland, Mich. The in-vehicle remote garage door opener 50 is integrated within the vehicle and may receive power from the vehicle battery and/or vehicle ignition. Previously, however, such remote garage door openers communicated directly with the garage door opener 20. More specifically, the trainable remote garage door openers could be trained to learn the signal protocols of a remote transmitter that comes with the garage door opener and later transmit a signal having those protocols. The present trainable remote garage door openers accommodate many different garage door opener protocols using multiple codes and signaling frequencies to provide integrated vehicle door access. Although primarily used for garage door control, in-vehicle remote garage door opener 50 is also capable of other remote control such as the control of lighting and gates.

Figure 2:
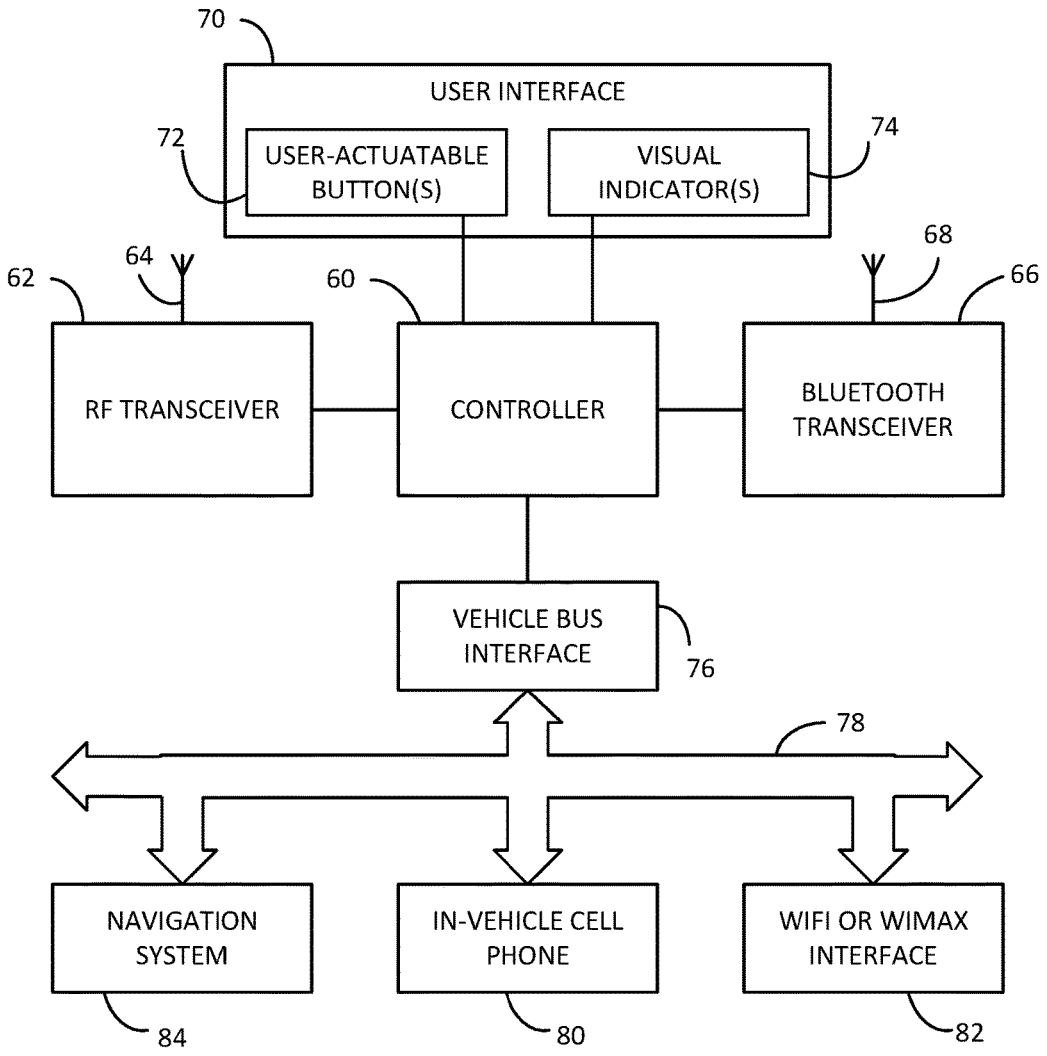
FIG. 2 is a block diagram showing an in-vehicle remote garage door opener that may be used in the control system of FIG. 1.

FIG. 2 shows an example of an in-vehicle remote garage door opener 50 that may be used in the control system 10. As shown, opener 50 may include a controller 60, an RF transceiver 62, a first antenna 64, an interface with an internet-connected device shown in the form of a Bluetooth transceiver 66, a second antenna 68, a user interface 70 including at least one user-actuatable input 72 and at least one visual indicator 74, and a vehicle bus interface 76 connected to a vehicle bus 78. Although shown as separate components, RF transceiver 62 and Bluetooth transceiver 66 may be integrated or partially integrated to share components.

Controller 70 may be a microprocessor programmed to respond to inputs from various components to control RF transceiver 62 to receive and transmit signals using antenna 64 that may be received from or transmitted to a garage door opener 20. Such inputs may come from user interface 70, a remote device such as a mobile device 40 via Bluetooth transceiver 66, or from various other components connected to vehicle bus 78 via bus interface 76 as described further below.

The construction of RF transceiver 62 and the control thereof by controller 60 are not described in detail herein with the exception of the modifications described below. Details may be found in U.S. Pat. Nos. 5,442,340; 5,479,155; 5,583,485; 5,614,891; 5,619,190; 5,627,529; 5,646,701; 5,661,804; 5,686,903; 5,699,054; 5,699,055; 5,793,300; 5,854,593; 5,903,226; 5,940,000; 6,091,343; 6,965,757; 6,978,126; 7,469,129; 7,786,843; 7,864,070; 7,889,050; 7,911,358; 7,970,446; 8,000,667; 8,049,595; 8,165,527; 8,174,357; 8,531,266; 8,494,449; 8,384,580; 8,264,333; and 8,253,528, the entire disclosures of which are incorporated herein by reference. Before discussing the modifications, an example is provided of one implementation of the in-vehicle remote garage door opener 50.

Figure 3:
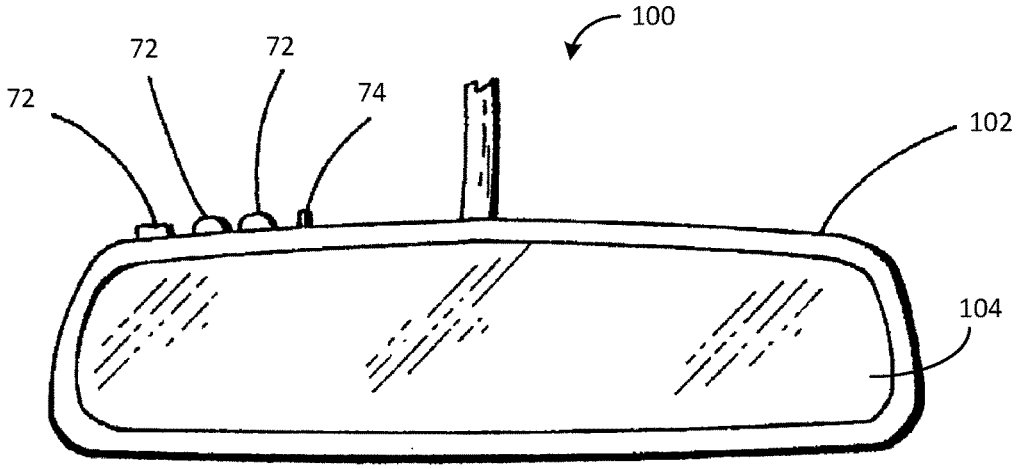
FIG. 3 is a perspective view of a rearview assembly incorporating the in-vehicle remote garage door opener of FIG. 2.

FIG. 3 shows an example of a vehicle accessory in the form of a rearview assembly 100 in which in-vehicle remote garage door opener 50 may be incorporated. Although shown in a rearview assembly 100, in-vehicle remote garage door opener 50 could be incorporated into various other vehicle accessories or locations within a vehicle. As shown in FIG. 3, rearview assembly 100 may include a housing 102 for mounting to the vehicle, and a rearview device 104 such as a rearview mirror element, a rearview display or both disposed in housing 102. Rearview assembly 100 may further include at least one user-actuated input 72, such as a push button, capacitive touch sensor, or optical sensor and at least one visual indicator 74 of user interface 70. Visual indicator(s) 74 may take the form of LED indicator lights or may be a display such as disclosed in U.S. Pat. No. 8,643,481, the entire disclosure of which is incorporated herein by reference. The remaining components of in-vehicle remote garage door opener 50 may be housed within housing 102 and are not shown in FIG. 3.

When provided in a rearview assembly 100 where rearview device 104 is an electro-optic mirror element, controller 60 may be configured to read outputs of light sensors (not shown) and control the reflectivity of the electro-optic mirror element. Further, controller 60 may be programmed to control any other components within rearview assembly 100 such as a display, map lights, a compass, an imager, and/or a headlamp control system. Controller 60 may further be programmed to control other vehicle accessories via vehicle bus 78.

Referring back to FIG. 1, garage door opener 20 may be configured to transmit a garage door open/closed status signal for remote monitoring. In-vehicle remote garage door opener 50 can display the door open/closed status in the vehicle using visual indicator(s) 74, sound, a display, an icon, or other means. By utilizing (a) a Bluetooth or WiFi link as an interface to an internet-connected mobile device 40 such as a smartphone or a cellular phone module, (b) WiMax, or (c) a wired or wireless link as an interface to an embedded vehicle cellular phone 80 (FIG. 2) or other means of internet access, in-vehicle remote garage door opener 50 can determine garage door status and control the garage door when the vehicle is beyond the range of a traditional short range garage door link.

An internet connection may need to be established between in-vehicle remote garage door opener 50 and the internet-connected door opener 20. Typically this connection would not be continuous to conserve power and bandwidth. Setting up this initial connection and user authentication can introduce delays exceeding 10 seconds in some cases. To achieve the best possible response time, a connection trigger can be used to set up the internet connection when it is likely to be needed while minimizing data charges. The trigger could be from a signal from internet-connected mobile device 40 including its image recognition system and fingerprint reader, cellular network location, a navigation system (such as a GPS location or a proximity from a GPS location), or vehicle bus 78. The trigger could also be from recognition of a particular WiFi SSID (as sensed by internet-connected mobile device 40 or an in-vehicle WiFi interface 82), time of day or other user selectable parameter. The actual open/close commands can then be processed more quickly when the link has been pre-established. The GPS information may come from an in-vehicle navigation system 84 or from internet-connected mobile device 40.

Optionally, rather than relying on a password in the internet-connected mobile device 40, a rolling code may be generated in in-vehicle remote garage door opener 50 and passed to the garage door opener 20 via the internet 30. This provides security in case the mobile device 40 is lost while also eliminating the need for password entry or other interaction with the mobile device 40 (such as fingerprint detection). The rolling code can be used as an additional security layer in addition to a password or in place of a password. One implementation could require password entry, face identification or fingerprint authentication on the mobile device 40 when not linked to the in-vehicle remote garage door opener 50. When the mobile device 40 is linked to the in-vehicle remote garage door opener 50, a rolling code could be passed in place of the authentication procedure.

Different garage door manufacturers may utilize different internet connectivity methods and security systems. If new models or manufacturers are introduced or security flaws are discovered, it may be desirable to update the in-vehicle garage door opener firmware. Such updates could be made via the vehicle bus, a dedicated RF link, WiFi, or Bluetooth. For the best security, the update could be requested by the in-vehicle module using SSL (Secure Sockets Layer) or other secure protocol. Updates could be downloaded automatically or triggered by user input to the in-vehicle module. Updates could also be initiated from a smartphone or other internet-connected device. Different buttons (physical or soft buttons) controlling the in-vehicle module may trigger multiple communication protocols depending on the models or manufacturers of the various devices linked to the buttons. The buttons may be used to trigger the execution of the appropriate applications on an internet-connected device to control the linked devices.

There can be a connection established with the home internet gateway 35 to in-vehicle system 50 as well. This ad hoc WiFi connection can be used to open the garage door. The other possible use would be to get information from the outside world like weather updates and traffic conditions near the current location while the car is inside the garage. The gateway would provide an active connection and the data rates on the phone could be avoided for a short amount of time. The kind of information requested can be set by the user and the downloaded data can be displayed on the rearview mirror interface or any other interface in the car. This could also be used to download over the air updates when the car is in the garage or within range.

The home internet gateway 35 may serve as a gateway for the internet-connected device 40 or the trainable transceiver to communicate with other devices within a home or other building. Gateway 35 may communicate with these other devices using a variety of communication protocols, such as Bluetooth mesh networking, ZigBee, and/or Zwave.

Once the door has opened using the various methods described above, the vehicle could be parked in the garage automatically using a forward and a reverse facing camera, and the two views can be displayed on the rearview mirror.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the claims as interpreted according to the principles of patent law, including the doctrine of equivalents.

What is claimed is:

1. An in-vehicle remote garage door opener for receiving signals through the internet from a garage door opener, the remote garage door opener comprising:

an RF receiver for receiving an RF signal during a training mode;

an RF transmitter for transmitting an RF signal to the garage door opener in an operating mode;

an interface configured to communicate with an internet-connected mobile device that is mobile relative to the vehicle; and a controller coupled to:

said interface; and at least one of the trainable RF receiver and the trainable RF transmitter;

wherein said controller is configured to receive signals via the mobile device and said interface that are sent through the internet from the garage door opener that indicates an open or closed status of a garage door.

2. The in-vehicle remote garage door opener of claim 1, further comprising an indicator coupled to said controller for indicating the status of the garage door to an occupant of the vehicle.

3. The in-vehicle remote garage door opener of claim 1, further comprising a user-actuated input coupled to said controller, wherein, upon actuation of said user-actuated input, said controller is configured to request a signal to be transmitted by the internet-connected mobile device through the internet to the garage door opener, the garage door opener configured to respond to the signal by opening or closing the garage door.

4. The in-vehicle remote garage door opener of claim 1 and further including a user-actuated input coupled to said controller, wherein, upon actuation of said user-actuated input, said controller is configured to cause said RF transmitter to transmit the RF signal to the garage door opener, the garage door opener configured to respond to the signals by opening or closing the garage door.

5. The in-vehicle remote garage door opener of claim 1, wherein said interface is a transceiver for wirelessly communicating with the internet-connected mobile device.

6. The in-vehicle remote garage door opener of claim 5, wherein said transceiver is a Bluetooth transceiver.

7. The in-vehicle remote garage door opener of claim 1, wherein said in-vehicle remote garage door opener receives power from one of a vehicle battery and vehicle ignition.

8. The in-vehicle remote garage door opener of claim 1, wherein said in-vehicle remote garage door opener is associated with a rearview assembly of the vehicle.

9. The in-vehicle remote garage door opener of claim 1, wherein said controller causes the internet-connected mobile device to initiate an internet connection with the garage door opener in response to a trigger signal.

10. The in-vehicle remote garage door opener of claim 9, wherein said trigger signal is received from the internet-connected mobile device.

11. The in-vehicle remote garage door opener of claim 10, wherein said trigger signal is received from the internet-connected mobile device in response to one of an image recognition system, a fingerprint reader, and a navigation system of the internet-connected mobile device.

12. The in-vehicle remote garage door opener of claim 9, wherein said trigger signal is received from a navigation system of the vehicle.

13. The in-vehicle remote garage door opener of claim 9, wherein said trigger signal is received from a vehicle bus.

14. The in-vehicle remote garage door opener of claim 9, wherein said trigger signal is generated in response to recognition of a particular Wi-Fi SSID.

15. An in-vehicle remote garage door opener for receiving signals through the internet from a garage door opener, the remote garage door opener comprising:

an indicator for indicating the status of the garage door to an occupant of the vehicle;

an interface configured to communicate with an internet-connected mobile device that is mobile relative to the vehicle; and a controller coupled to said indicator and said interface, wherein said controller is configured to receive signals via the mobile device and said interface that are sent through the internet from the garage door opener that indicates an open or closed status of the garage door and wherein, in response to said signals, said controller controls said indicator to indicate the open or closed status of the garage door.

16. The in-vehicle remote garage door opener of claim 15 and further including a user-actuated input coupled to said controller, wherein, upon actuation of said user-actuated input, said controller is configured to request a signal to be transmitted by the internet-connected mobile device through the internet to the garage door opener, the garage door opener configured to respond to the signal by opening or closing a garage door.

17. The in-vehicle remote garage door opener of claim 15 and further comprising:

a user-actuated input coupled to said controller;

an RF receiver coupled to said controller for receiving an RF signal during a training mode;

an RF transmitter coupled to said controller for transmitting an RF signal to the garage door opener in an operating mode; and wherein, upon actuation of said user-actuated input, said controller is configured to cause said trainable RF transceiver to transmit the RF signal to the garage door opener, the garage door opener configured to respond to the signals by opening or closing the garage door.

18. The in-vehicle remote garage door opener of claim 15, wherein said interface is a transceiver for wirelessly communicating with the internet-connected mobile device.

19. The in-vehicle remote garage door opener of claim 18, wherein said transceiver is a Bluetooth transceiver.

* * * * *